US011000094B2

(12) United States Patent
Vizy

(10) Patent No.: US 11,000,094 B2
(45) Date of Patent: May 11, 2021

(54) PAIN PREVENTION FOOTWEAR SOLE

(71) Applicant: Wolverine Outdoors, Inc., Rockford, MI (US)

(72) Inventor: Anthony D. Vizy, Marblehead, MA (US)

(73) Assignee: Wolverine Outdoors, Inc., Rockford, MI (US)

( * ) Notice: Subject to any disclaimer, the term of this patent is extended or adjusted under 35 U.S.C. 154(b) by 148 days.

(21) Appl. No.: 16/555,628

(22) Filed: Aug. 29, 2019

(65) Prior Publication Data

US 2021/0059355 A1 Mar. 4, 2021

(51) Int. Cl.

| | |
|---|---|
| ***A43B 7/14*** | (2006.01) |
| ***A43B 13/41*** | (2006.01) |
| ***A43B 13/22*** | (2006.01) |
| ***A43B 23/22*** | (2006.01) |
| ***A43B 13/16*** | (2006.01) |

(52) U.S. Cl.

CPC ..... *A43B 13/41* (2013.01); *A43B 7/14* (2013.01); *A43B 13/16* (2013.01); *A43B 13/223* (2013.01); *A43B 23/22* (2013.01)

(58) Field of Classification Search

CPC ..... A43B 13/223; A43B 7/14; A43B 13/16; A43B 13/41; A43B 23/22; A43B 23/222

USPC ..... 36/31, 72 A, 76 R

See application file for complete search history.

(56) References Cited

U.S. PATENT DOCUMENTS

| | | | | |
|---|---|---|---|---|
| 2,433,034 | A * | 12/1947 | Edinger | A43B 13/41 36/179 |
| 2,457,481 | A * | 12/1948 | MacArthur | A43B 7/22 36/161 |
| 2,716,296 | A * | 8/1955 | Stein | A43B 23/22 36/76 R |
| 5,052,130 | A | 10/1991 | Barry et al. | |
| 5,647,145 | A * | 7/1997 | Russell | A43B 3/0052 36/25 R |
| 6,199,303 | B1 * | 3/2001 | Luthi | A43B 7/142 36/107 |
| 6,880,266 | B2 | 4/2005 | Schoenborn et al. | |
| 7,395,613 | B2 | 7/2008 | Schoenborn et al. | |
| 7,954,257 | B2 | 6/2011 | Banik | |
| 8,984,775 | B2 * | 3/2015 | Dombrow | A43B 23/0295 36/102 |
| 9,615,625 | B1 | 4/2017 | Huard et al. | |

(Continued)

*Primary Examiner* — Marie D Bays

(74) *Attorney, Agent, or Firm* — Warner Norcross + Judd LLP

(57) ABSTRACT

An article of footwear including an upper and a sole assembly configured to provide broad base structural support and stability to a wearer's foot to promote pain prevention in the wearer. The footwear can include a midsole including a stability bridge that enhances torsional rigidity in an arch region, a bifurcated rigid central shank disposed in the arch region under the stability bridge that is visible to a viewer of the footwear and an outsole disposed below the midsole and the bifurcated central shank. The outsole can include a ladder tread section, disposed below the bifurcated central shank, that less than 5 mm above a lowermost surface of the remainder of the outsole so that the outsole includes a substantially flat ground contacting surface to promote stability. The outsole also can include an upwardly curved rearmost heel strike tread, and heel and/or forefoot impact absorption comfort pods in associated midsole voids.

20 Claims, 8 Drawing Sheets

(56) References Cited

U.S. PATENT DOCUMENTS

| | | | | |
|---|---|---|---|---|
| 2005/0267775 | A1 | 12/2005 | Willis | |
| 2006/0168847 | A1* | 8/2006 | Myers | A43B 7/08 36/3 B |
| 2012/0159814 | A1* | 6/2012 | Smith | A43B 13/12 36/92 |
| 2014/0360052 | A1* | 12/2014 | Keating | A43B 13/223 36/103 |
| 2015/0135558 | A1* | 5/2015 | Inomata | A43B 13/14 36/25 R |
| 2015/0223563 | A1* | 8/2015 | Liebeno | A43B 13/125 36/31 |
| 2015/0272269 | A1* | 10/2015 | Niskanen | A43B 7/1425 36/30 R |
| 2015/0327624 | A1* | 11/2015 | Grott | A43B 5/002 36/91 |
| 2017/0079373 | A1* | 3/2017 | Huard | A43B 7/144 |
| 2020/0214389 | A1* | 7/2020 | Hatano | A43B 7/1445 |

* cited by examiner

PAIN PREVENTION FOOTWEAR SOLE

BACKGROUND OF THE INVENTION

The present invention relates to footwear, and more particularly to footwear having a sole assembly designed to promote and enhance pain prevention in a wearer.

Various occupations require workers to be on their feet a significant portion of the workday. One particularly grueling occupation is that of the construction worker. Many times, a construction worker is on their feet, traversing many different types of terrain, obstacles and objects throughout the day. In one part of the day, they may stand for long periods on concrete or hard surfaces, while at other times they may traverse a rough, uneven ground surface to retrieve tools and/or carry items. Thus, their footwear must be able to provide substantial cushioning, as well as traction and support.

Many footwear manufacturers attempt to produce work footwear that provide the above characteristics. However, to mass produce such footwear, some generalizations are made so that the footwear fits a fairly wide cross section of potential wearer's feet. For example, many footwear are made and assembled on sets of lasts corresponding to particular foot sizes. While the lasts are generally sized to lengths and widths of "average" sized feet, many types of lasts do not take into account the proper and anatomic shapes of individual feet. Thus, the resulting footwear might not fit a particular wearer's foot anatomically to begin with, and/or may not fit the wearer's foot as the foot expands, so the footwear in some cases can constrict a foot's motion and expansion over the course of the day. In turn, this ill fitment of the footwear potentially contributes to pain and fatigue of the wearer.

In some cases, construction workers repeatedly climb structures to perform special tasks throughout the day. As one example, workers can climb and stand on ladders for extended periods. As a result, workers can become fatigued. Some manufacturers address this by including a reinforced ladder grip in the arch. Such grips typically are recessed far up into the arch. As a result, the wearer's arch is held in a significantly elevated configuration. Some believe that this elevated or lifted arch configuration reduces fatigue in the worker's feet. Others believe, however, that increased arch support for long periods of time actually can cause discomfort in the user's foot due to over extension of and general pressure on the muscles and ligaments in the arch of the foot.

In addition to including special features, such as ladder grips, footwear for workers in the construction industry, as well as other labor-intensive industries, typically is constructed for durability and stability as well as protection. Such footwear can be somewhat heavy due to the additional materials used in such constructions. Some manufacturers thus reduce the amount of cushion or sole material to reduce weight and prevent fatigue. While this works in some cases, such a reduction in cushioning and associated energy return can reduce the overall function of the footwear. As a result, while a user might not feel fatigued while at work, for example, on a job site, after work, the user may experience lower back pain, joint pain and/or muscle aches, which may in turn prevent or impair the user from participating in activities after their workday. In turn, this can influence the user's quality of life outside of their workday.

Accordingly, there remains room for improvement in the field of work footwear to provide structural support and stability to a worker's and thereby reduce or impair likelihood that the worker will experience pain or discomfort after their workday is complete.

SUMMARY OF THE INVENTION

Footwear is provided including an upper and a sole assembly configured to provide broad base structural support and stability to a wearer's foot to promote and enhance pain prevention in the wearer.

In one embodiment, the footwear sole assembly can include a midsole including a stability bridge that enhances torsional rigidity in an arch region. The midsole can be constructed from a material having different densities in different portions. For example, the midsole can include a midsole forefoot portion, a midsole arch portion and a midsole heel portion. The stability bridge can be disposed in the midsole arch portion. The material can have a first density in the stability bridge, generally in the midsole arch portion, and a second density in the heel midsole portion and forefoot midsole portion. The second density can be less than the first density and/or the first density can be greater than the second density. With its greater density, the stability bridge in the arch midsole portion can provide greater torsional stiffness in the footwear, and specifically in the arch.

In another embodiment, the sole assembly can include a bifurcated rigid central shank including two separate shanks in some cases. These shanks can be disposed in the arch region of the footwear, optionally under the stability bridge. The shanks can be visible to a viewer of the footwear, optionally from both lateral and medial sides of the footwear. This can provide a visible story to the potential consumer that the shanks are is indeed incorporated into the footwear.

In still another embodiment, the central shanks can be constructed to include a lateral shank and a medial shank that are joined via a shank connector. Each shank can be specifically engineered in shape and function for their lateral and medial locations. Where included, the shank connector can be disposed between opposing interior edges of each of the lateral and medial shanks. The medial shank can be longer than the lateral shank and can extend toward and terminate behind the first metatarsal head of the wearer's foot. The shanks also can extend rearward toward a heel cleft to assist in setting a neutral foot stance of the wearer.

In yet another embodiment, the sole assembly can include an outsole disposed below the midsole and the bifurcated central shank. The outsole can include a ladder tread section, disposed below the bifurcated central shank, that less than 5 mm above a lowermost surface of the remainder of the outsole. With this construction, the outsole can include a substantially flat ground contacting surface to promote stability and comfort. With a combination of the stability bridge, central shank and ladder tread, the footwear can provide significant support and stability to combat fatigue and easily traverse uneven surfaces over a long workday of the wearer.

In even another embodiment, the outsole can include an upwardly curved rearmost heel strike tread. This heel strike pad can assist in impact deceleration, making work footwear feel more like well cushioned and gait facilitating athletic footwear.

In a further embodiment, the midsole can define an upwardly opening forefoot void and a downwardly opening heel void, optionally above the heel strike tread. The forefoot void can be occupied by a forefoot comfort pod constructed from a second material, different from a first material of the remainder of the midsole. The second material can provide dispersement of forces into adjacent midsole material. The forefoot comfort pod can be disposed generally under the metatarsal heads of a wearer's foot and/or under the ball of the wearer's foot to provide support and distribute forces in this high-pressure area as the wearer's foot rolls through and progresses to toe off during the gait cycle. In particular, forces project from a wearer's foot and leg down toward the ground. The forefoot comfort pod can provide more cushioning close to origin of these forces.

In still a further embodiment, the downwardly opening heel void can be occupied by a heel comfort pod constructed from the second material. The heel pod can help absorb impact and improve deceleration of the footwear upon heel strike with an underfoot surface.

In yet a further embodiment, the outsole can include multiple tread sections extending outward from a longitudinal base section in a cantilevered manner, with those forefoot tread sections separated from one another by respective gaps and attached at their upper surfaces with a midsole lower surface. Other portions of the midsole lower surface optionally can be exposed through the respective forefoot tread gaps, generally between the forefoot tread sections. With these forefoot tread gaps defined by the outsole, the outsole can have increased flexibility and reduced weight in the forefoot region, as well as the heel region, when such tread sections separated by gaps are included there.

In even a further embodiment, the longitudinal base section can extend from the forefoot region to the heel region of the footwear. The longitudinal base section can define a pressure curve groove that undulates between a medial side and a lateral side of footwear disposed opposite one another across a longitudinal axis of the footwear. The forefoot tread gaps can be disposed transverse to the pressure curve groove.

In even another embodiment, the midsole lower surface can define midsole lower surface grooves that are transverse to the longitudinal base section and/or the pressure curve groove. These components can in some cases help the sole assembly and footwear in general move more naturally with the motion of the foot in a gait cycle.

In another, further embodiment, the footwear can include a compression ankle element to combat swelling of the ankle and/or foot, and to provide substantial support in the ankle region. This compression ankle element, sometimes referred to as a comfort sleeve, or secondary ankle collar, can include a forward panel and a heel panel that are joined together via side sleeve panels. This comfort sleeve can be inset and gapped from a primary ankle collar of the upper, and can separately encircle and/or surround the ankle or portions of a wearer's leg above the ankle. The lower portion of the comfort sleeve or secondary ankle collar can be stitched, sewn or otherwise joined with the primary ankle collar of the upper. The uppermost portions of the comfort sleeve can extend upward, above the uppermost edge of the primary ankle collar of the upper.

The footwear of the current embodiments provides a sole assembly having a broad base of a support, stability and all day comfort for a wearer to promote and/or enhance pain prevention in the wearer. With the bifurcated shank and stability bridge, the footwear is provided with torsional rigidity to handle a variety of terrain types and uneven surfaces on a job site or other location of work of the wearer. In turn, this provides flexibility to the foot yet also provides enhanced structural stability. The forefoot and heel portions of the sole assembly also can be provided with enhanced flexibility, yet provide stability, when the outsole is outfitted with separated transverse tread sections that are separated by tread gaps. Where the heel and/or forefoot comfort pods are included, enhanced cushion and impact absorption is provided in key locations of the footwear to improve gait cycle and assist in impact deceleration and absorption.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
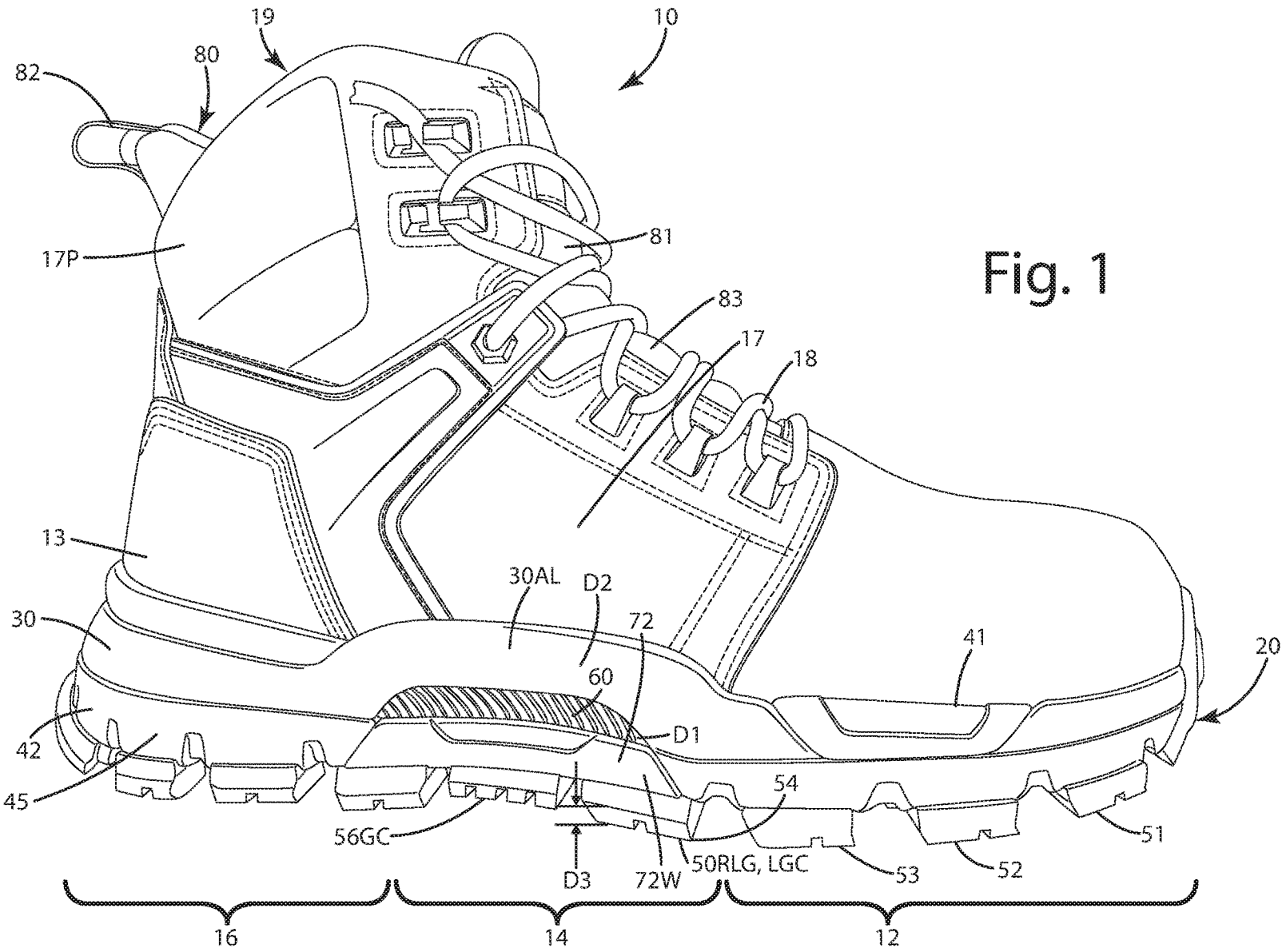
FIG. 1 is a side view of footwear and an associated sole assembly of a current embodiment.

A current embodiment of the footwear is illustrated in FIGS. 1-9, and generally designated 10. The footwear can include a sole assembly 20 including a multicomponent, multi-density midsole 30, having a forefoot pod 41 and a heel pod 42, an underlying outsole 50, a stability bridge 60, an exposed split shank 70 and a generally flat lower ground contacting surface 54.

Although the current embodiment is illustrated in the context of a work boot, the construction can be incorporated into any type or style of footwear, including performance shoes, trail shoes and boots, hiking boots, all-terrain shoes, running shoes, athletic shoes, running shoes, sneakers, conventional tennis shoes, walking shoes, multisport footwear, casual shoes, dress shoes or any other type of footwear or footwear components. When so incorporated into other footwear constructions, the embodiments herein can have similar results and benefits. Generally, the construction is well suited for rough uneven terrain having a variety of different types of underfoot features that may engage the footwear. The sole assembly herein can provide reactive and dynamic traction, yet extended comfort and support, thus enabling the wearer to have confidence in their footing, even on very uneven and unstable surfaces.

Figure 4:
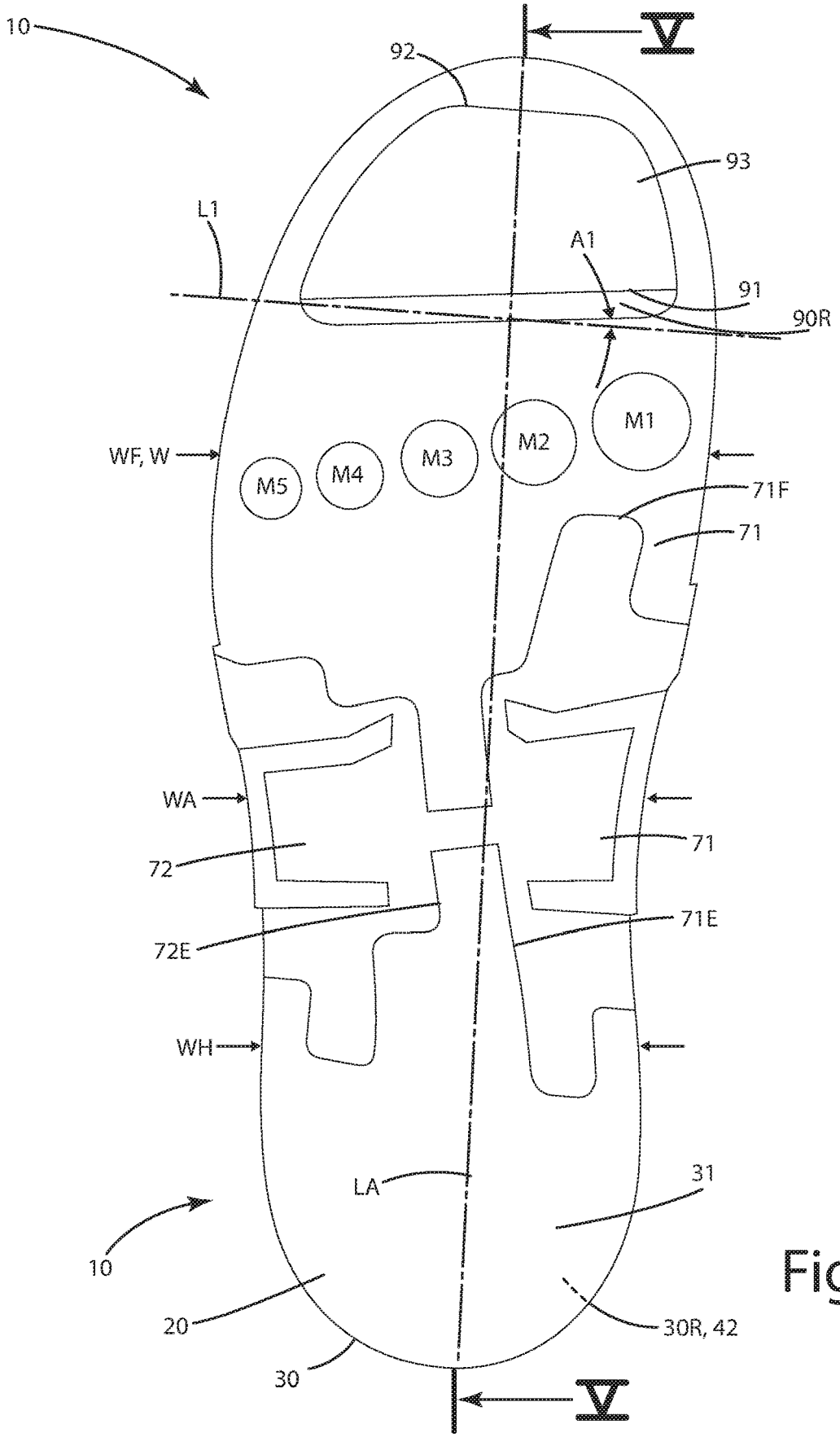
FIG. 4 is a top view of the sole assembly.

It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations. Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe. The use of directional terms should not be interpreted to limit the invention to any specific orientation. Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot region 12, arch region or mid-foot region 14, and heel region 16 generally are identified in FIG. 1. However, it is to be understood that delineation of these regions may vary depending upon the configuration of the sole assembly and/or footwear. The sole assembly 20 can include a side-to-side width W, a heel-to-toe longitudinal length L and a longitudinal axis LA, which can be shared with the footwear, sole assembly, and other components as illustrated in FIG. 4.

The outsole 50, can include a lowermost or ground contacting surface 50RLG and/or LGC, and can include multiple lugs, treads, spikes, cleats and/or other features designed to enhance traction between the footwear and an underlying surface. More or fewer elements of the sole assembly 20 can be included in some embodiments. Further, the components can be integrated into the midsole 30, which can be a single one piece unit. The components of the sole assembly can individually and/or collectively provide the article of footwear 10 with a number of attributes, such as support, rigidity, flexibility, stability, cushioning, comfort, reduced weight and/or other attributes. Generally, regardless of which components are present, the sole assembly 20 can form the bottommost portion of the footwear 10.

The footwear 10 can include a leather upper 17 joined with the sole assembly 20. The upper 17 can be formed from a variety of material elements joined together to cover at least a portion of the wearer's foot. The material elements can be selected based on the intended uses of the article of footwear 10, and can include synthetic textiles, mesh textiles, canvas polymers or leather, for example. The upper 17 can define an upper opening 19 for receiving the wearer's foot. The upper 17 can include one or more closure elements, including for example, shoe laces 18. The upper can include a lower periphery 13 that is attached to the sole assembly 20.

A footbed or sock liner 15 can be positioned within a foot void defined by the upper and can be non-stretchable and lightweight and joined to the upper to provide a void for receipt of the wearer's foot. The footbed can be constructed from a molded material, such as EVA foam, PU, latex, gel or other materials, and by virtue of its compressibility, provide cushioning, and may also conform to the foot in order to provide comfort, support, and stability. The lower peripheral allowance or edge 13 of the upper can be stitched, cemented, or otherwise fastened to the footbed around the perimeter of the footbed. The upper can include a Strobel board 17SB, which can be attached to the peripheral allowance 13. The joining of the sole assembly/outsole and the upper can be accomplished using adhesives, cement, injection molding, pour molding or any other technique used to join an upper and sole assembly.

Figure 9:
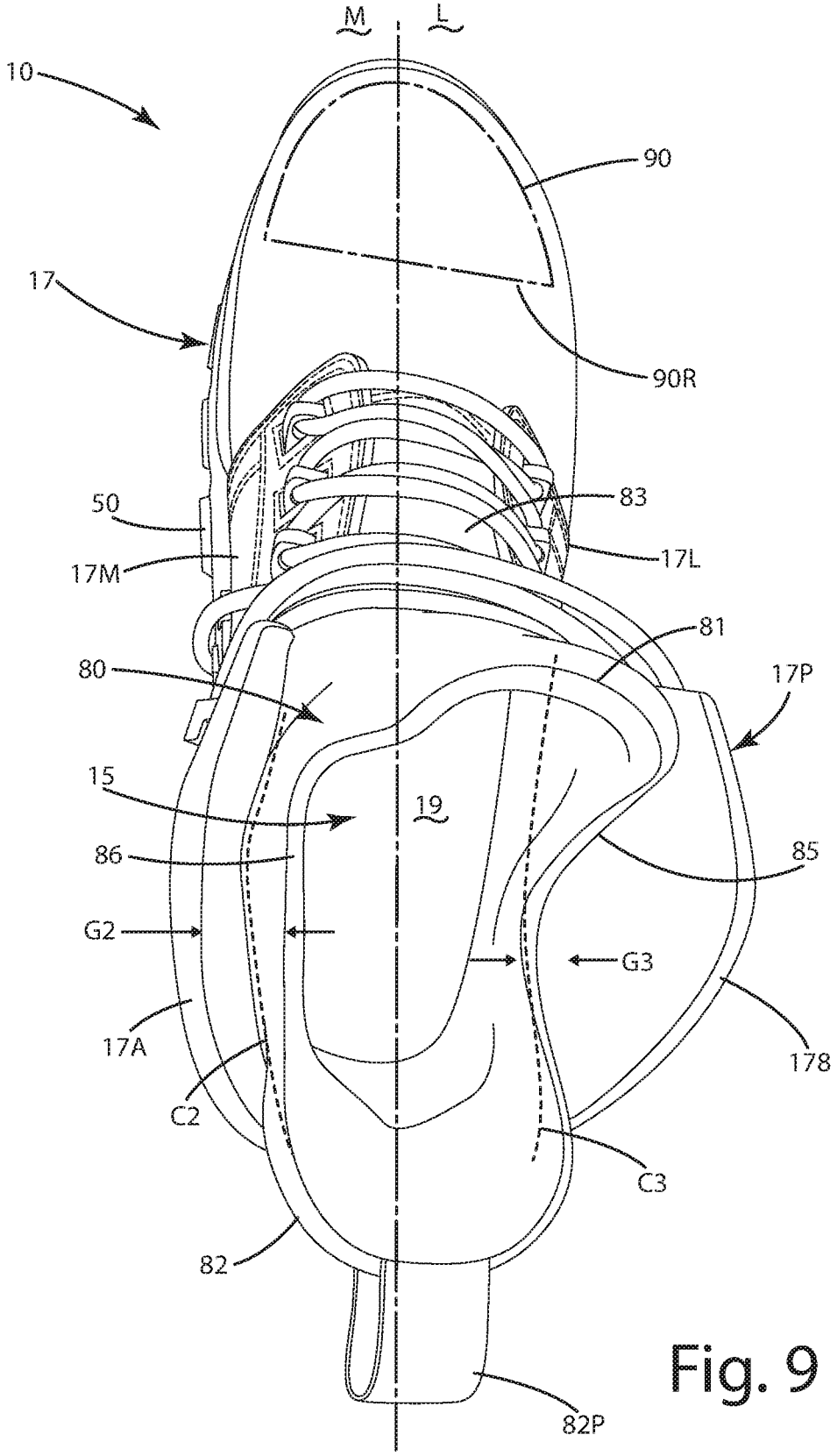
FIG. 9 is a top view of the footwear.

Optionally, in some applications, the upper 17 can include a comfort sleeve 80, also referred to as a secondary ankle collar herein. The comfort sleeve can negate the necessity of a conventional tongue, typically found in work boots. The comfort sleeve can include a front portion 81 that extends downward over the instep of the footwear to a bridge panel 83 that extends from a lateral side L to a medial side M across a longitudinal axis LA of the footwear. This bridge panel 83 can be connected to both the lateral 17L and medial 17M panels of the upper 17, without there being gaps disposed between the edges of that panel and those lateral and medial panels, like there would be with a tongue. The comfort sleeve front portion 81 can extend rearward and can be connected to sleeve side panels 85 and 86 that transition to the rearward heel panel 82, which can heel pull tab 82P at its uppermost extent. The sleeve side panels 85 and 86 can be spaced the gaps G2 and G3 from the respective upper side panels 17A and 17B. The sleeve side panels 85 and 86 can be free from attachment to those respective upper side panels 17A and 17B above connection elements C2 and C3, which can be lines of stitching, adhesive or welds that secure those sleeve side panels to the interior surfaces of the respective upper side panels 17A and 17B. This in turn can provide a level of freedom for the comfort sleeve 80 to move around and within the upper side panels 17A and 17B, and generally around and relative to the upper, inside the opening 19. Optionally the comfort sleeve can be made from stretchable soft liner material, such as neoprene, Lycra, Spandex or other materials. In some cases, the sleeve as mentioned above, forms a secondary ankle collar 80 that is disposed inwardly from the primary ankle collar 17P of the upper. The secondary ankle collar can surround the ankle of a wearer. Likewise, the primary ankle collar can also surround the ankle of the wearer, but outwardly from the secondary ankle collar. As shown in FIG. 9, the primary and secondary ankle collars can be separately constructed, but joined at the lowermost edges or connection rim of the secondary ankle collar via stitching, sewing, welding, gluing or other techniques.

Figure 3:
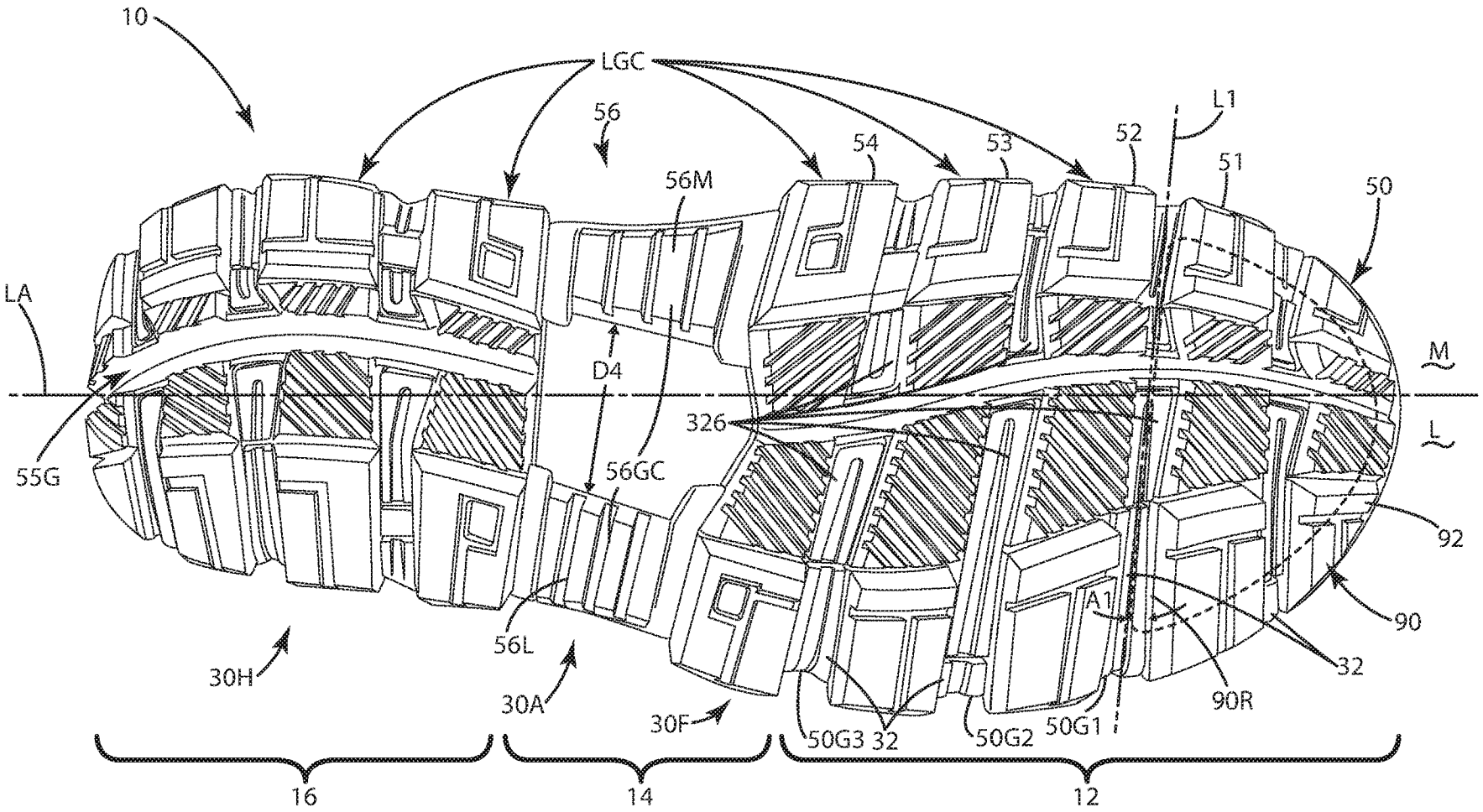
FIG. 3 is a bottom view of the sole assembly.

In some applications, the footwear 10 can include a protective toe element 90, which can include a toe box 93 defining a void to receive toes of a wearer, a forwardmost portion 92 and a rearward most portion 91. The rearward most portion 91 can include a rear edge 90R. This rear edge can be offset from a line L1, which is perpendicular to the longitudinal axis LA. For example, this rear edge 90R can be offset at an angle A1 relative to that line L1, which is perpendicular to the longitudinal axis LA. This angle A1 offset can be optionally between 1° and 20°, inclusive, between 1° and 15° inclusive, between 1° and 10° inclusive, between 1° and 5° inclusive, or between 1° and 2.5° inclusive. As shown in FIG. 3, this angular offset can be selected so as to better align the rear edge 90R with a gap 50G1 in the outsole 50 to provide flexibility in the forefoot 12 of the footwear 10. This gap 50G1 can be disposed between adjacent outsole lateral tread sections 51 and 52. Additional gaps 50G2, 50G3, and so on can be disposed between other outsole lateral tread sections 53 and 54 as described below.

Optionally, the midsole 30 can include a forward recess 30TP in the forefoot midsole portion 30F. This recess 30TP can be configured to receive the protective toe element 90 as described above. The protective toe element 90 can be glued, cemented, stitched, welded or otherwise disposed in that recess.

The upper 17 and associated sole assembly 20 can be configured to have a larger than normal forefoot width WF. This forefoot width WF can alleviate discomfort and provide additional space throughout the day as a wearer's foot begins to swell. This larger width can provide more volume inside the foot void defined by the upper and sole assembly within which the wearer's foot is disposed. This forefoot width WF optionally can be at least 5 mm, at least 10 mm, at least 15 mm, at least 20 mm or at least 40 mm greater than the heel width WH of a particular footwear and in a particular size. Of course, other widths of the forefoot and can be selected, depending on the application and a particular shoe size of the footwear 10. Further, in some cases, the footwear can be wider in the lateral midfoot area, or lateral side of the arch region, because many wearer's feet are wider there, and many shoes compress the foot there in the lateral arch region. By making the sole assembly and upper wider there, this can impair or reduce fatigue, discomfort and pain over the course of a long workday.

Figure 2:
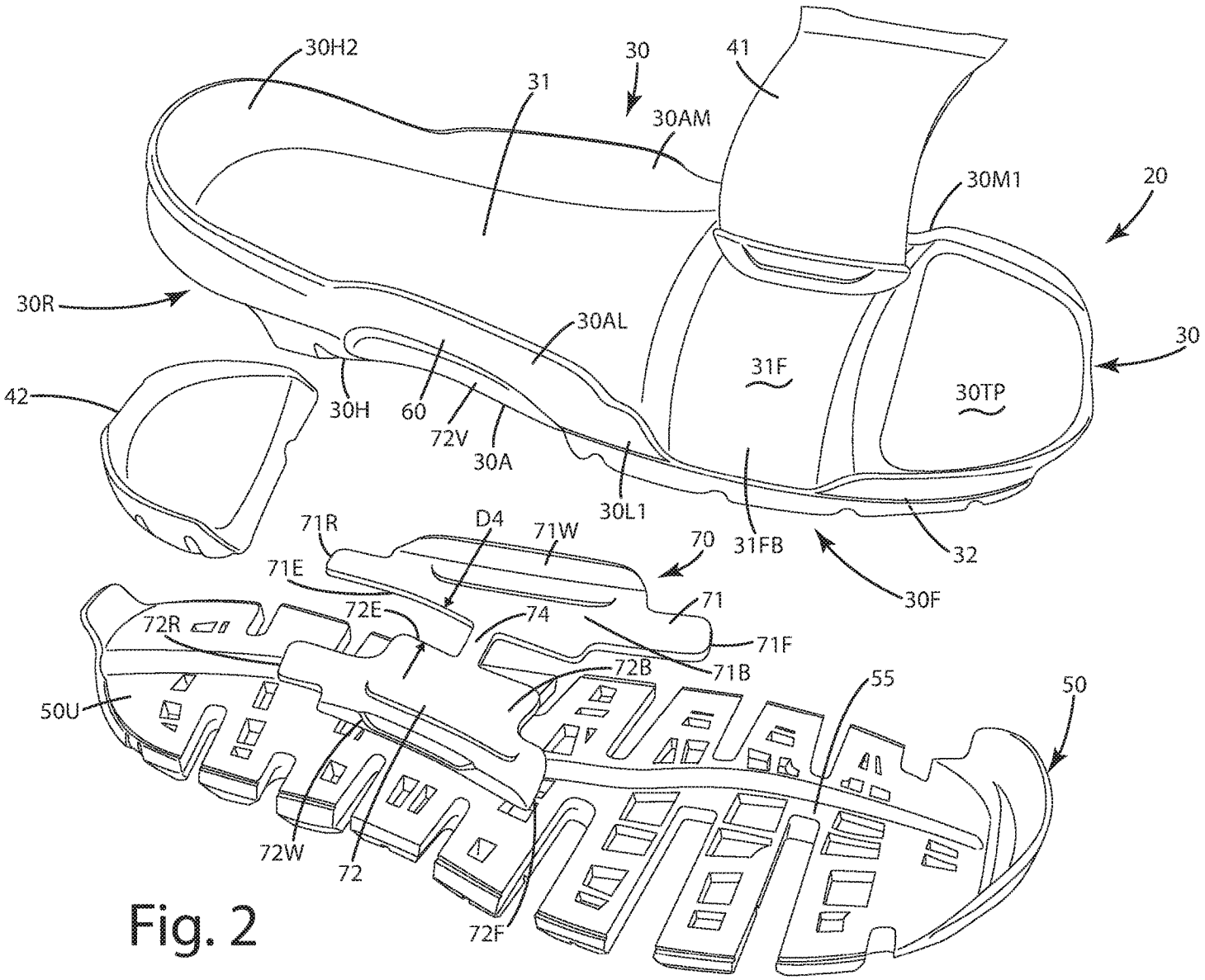
FIG. 2 is an exploded view of the sole assembly.

As shown in FIGS. 1-5, the sole assembly 20 can include the midsole 30, central shank 70, outsole 50 and comfort pods 41 and 42. The midsole 30 can include a forefoot midsole portion 30F, a heel midsole portion 30H in an arch midsole portion 30A. The arch midsole portion 30A can connect the heel midsole portion and the forefoot midsole portion and can be integrally formed with both of those portions. The midsole can include an upper surface 31 that generally extends across each of the forefoot midsole portion, arch midsole portion and heel midsole portion as shown in FIGS. 2 and 4, as well as a midsole lower surface 32 extending along the length L and width W of the assembly 20.

In the arch portion 30A and heel portion 30H, the midsole 30 can include one or more upstanding walls. For example, the arch midsole portion can include a medial bridge wall 30AM and a lateral bridge wall 30AL that extend upwardly from the upper surface 31 of the midsole. The medial bridge wall and lateral bridge wall can be visible to a viewer of the exterior of the footwear, for example, a heel in a side view of the footwear. These medial and lateral bridge walls can transition to an integral heel stabilizer 30H2 disposed in the heel region 16 and extending upwardly from the heel midsole portion 30H. This heel stabilizer can be in the form of a wall that transitions forwardly to each of the respective medial bridge wall and lateral bridge wall, and can be contiguous and integral with those respective walls. Each of these medial and lateral bridge walls, as well as the optional heel stabilizer 30H2 can extend upwardly along respective panels of the upper 17 on lateral and medial sides of the longitudinal axis of the footwear.

The midsole 30 can include a stability bridge 60. The stability bridge 60, shown in FIGS. 1 and 7, can be integrally formed with the remainder of the midsole 30 and particularly integrally formed with the remainder of the arch midsole portion 30A. The stability bridge 60 can be constructed from the same material M1 but can have a first density, D1 which is different from a second density D2 of the remainder of the midsole 30. The first density D1 can be greater than the second density D2. For example, the first density D1 can be optionally at least 10%, at least 20%, at least 25%, at least 30%, at least 40%, at least 50% more dense than the first density D2, even though the parts of the midsole with the different densities are constructed from the same material M1 in the arch midsole portion 30A.

Optionally, the material M1 can be a cushioning material, for example, a foam, such as an ethylvinyl acetate (EVA) foam. Again, the material can be more dense in the arch midsole portion, and particularly in the stability bridge located there. With this increased density in the arch midsole portion, this area of the footwear can exhibit a greater torsional stiffness than the forefoot midsole portion and/or the heel midsole portion. By torsional stiffness, it is meant that the arch is resistant to torsional forces, rotational forces or moments exerted about a longitudinal axis in the arch midsole portion or about the stability bridge of the footwear.

Figure 5:
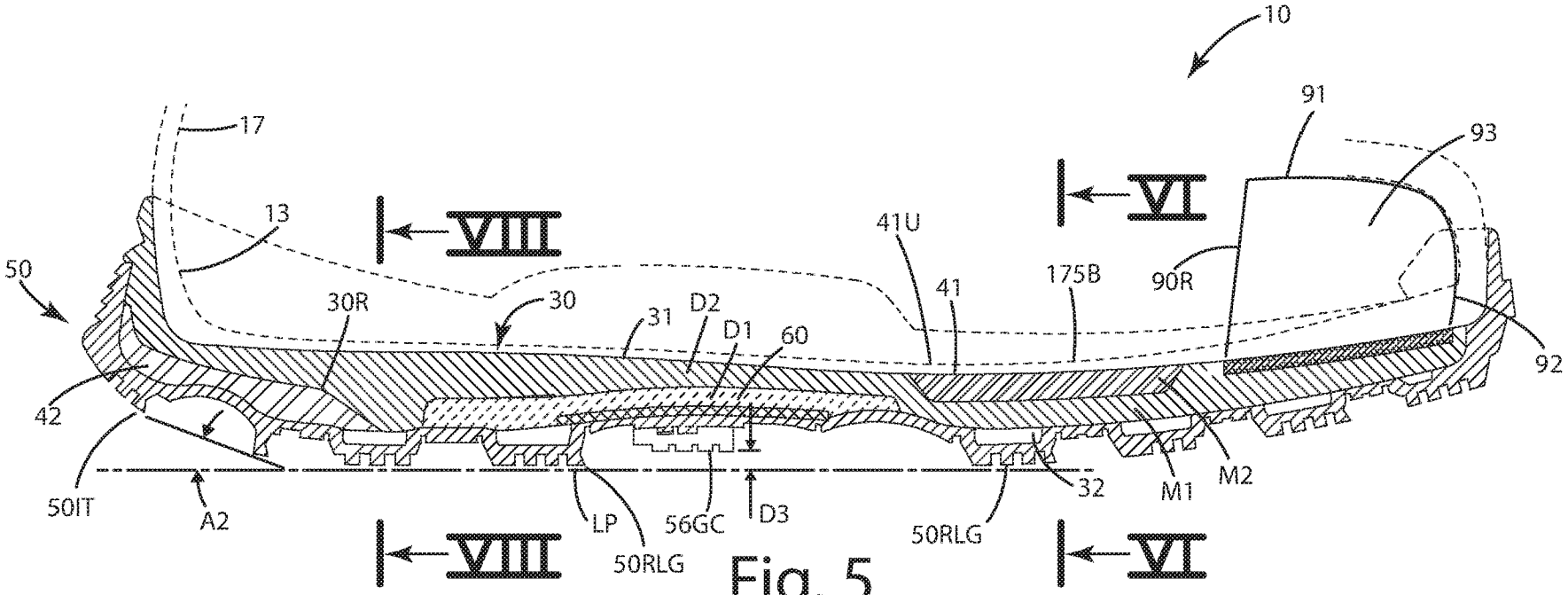
FIG. 5 is a section view of the sole assembly taken along line V-V of FIG. 5.

With reference to FIGS. 2, 4 and 5, the midsole 30 also can define an upwardly opening recess 31F defined by the upper surface 31 of the midsole. This recess 31F can extend laterally, across the entire width WF, W of the sole in the forefoot region 12. The upwardly opening forefoot recess 31F can extend all the way to the sole sidewalls 30L1 and 30M1 on opposite sides of the footwear. This recess, however, does not extend to the midsole lower surface nor is contiguous with the midsole lower surface 32. This forefoot recess 31F can be configured to be disposed under the first through fifth metatarsal heads M1-M5, and generally under the ball of the foot of a wearer.

Figure 6:
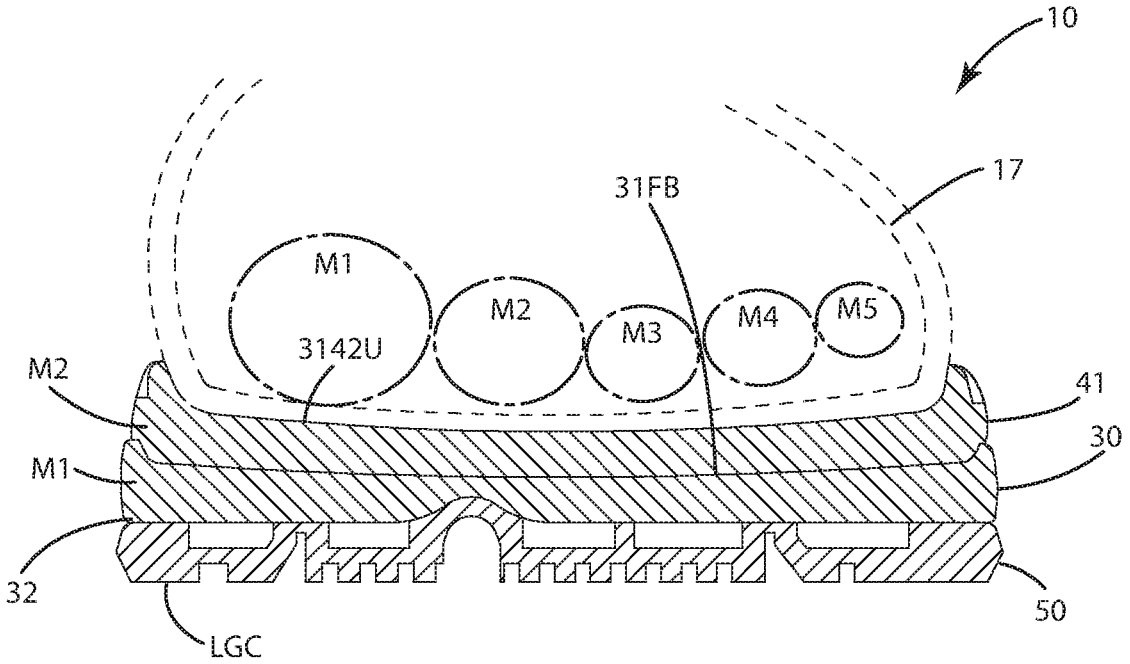
FIG. 6 is a section view of the sole assembly taken along line VI-VI of FIG. 5.
Figure 7:
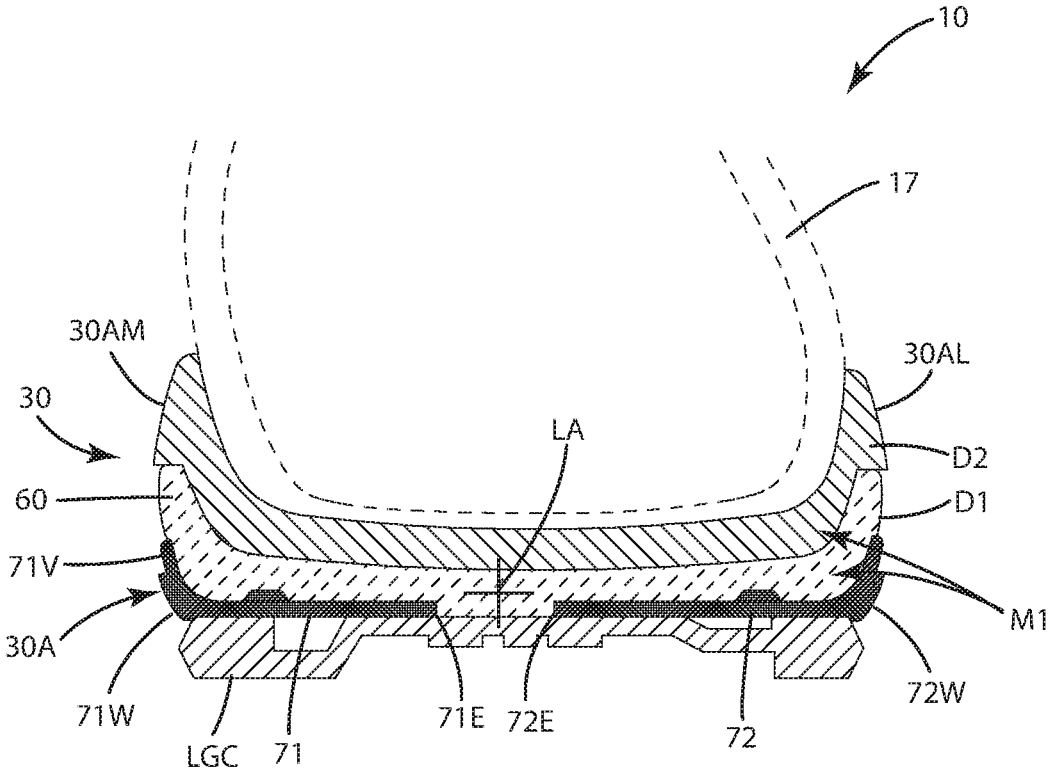
FIG. 7 is a section view of the sole assembly taken along line VII-VII of FIG. 5.
Figure 8:
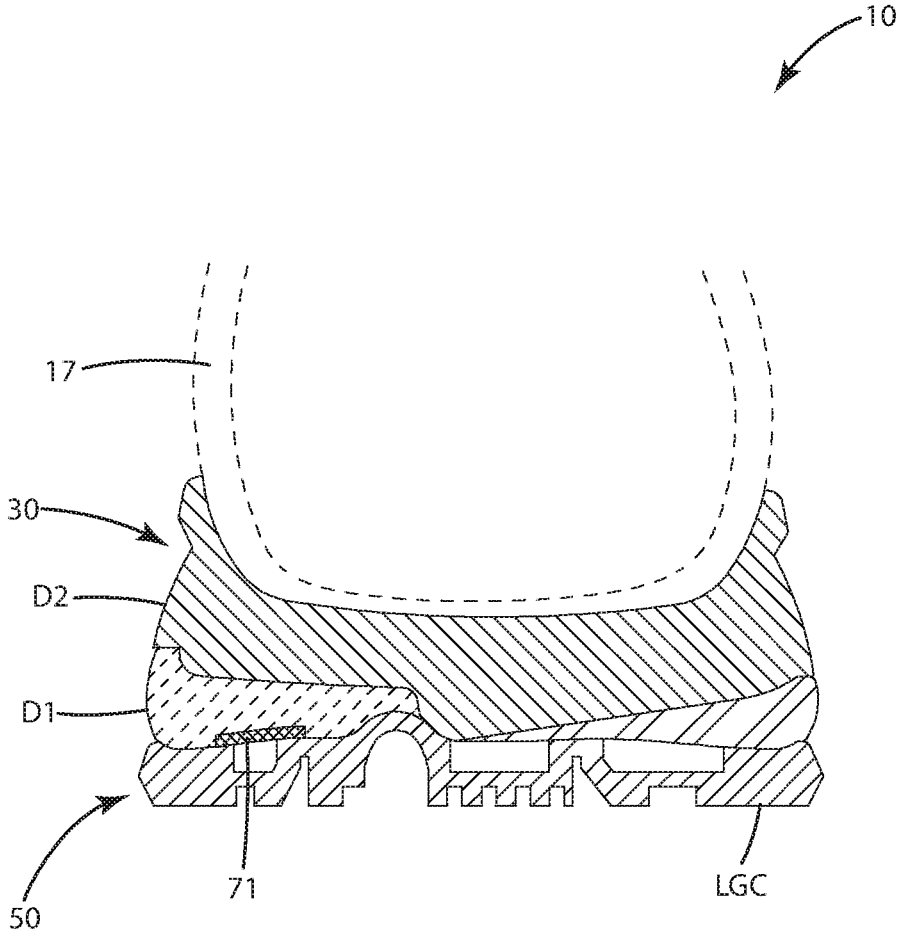
FIG. 8 is a section view of the sole assembly taken along line VIII-VIII of FIG. 5.

Further, as shown in FIGS. 2, 4 and 5, the upwardly opening forefoot recess 31F, sometimes referred to as a second void in the forefoot region 12, can be occupied with a forefoot pod 41. This forefoot pod can extend laterally across the entire width WF, W of the forefoot region. It can be glued, fastened, welded or otherwise secured in the recess 31F to the midsole and the surfaces adjacent the forefoot recess. The forefoot pod 41 can be secured under and/or to a Strobel board 17SB of the upper 17. It can include an upper surface 41U, which can be coextensive with the upper surface 31 of the remainder of the midsole 30 as shown in FIG. 6.

The comfort forefoot pod 41 can include a third density, different from the first and second densities described above. This third density optionally can be less than the first and second densities described above. In turn, it can have more energy return and better resilience than the other materials. The forefoot pod can be constructed from a second material M2, different from the first material M1, described above. For example, the second material M2 can be a EVA foam with Styrene-Butadiene-Styrene (SBS) blended in, so as to make it more durable and applicable for a work boot or other similar footwear. Of course, other types of foams, gels, latex, polyurethane or polymers can be used as the material M2. In addition, the material M2 can have a durometer that is greater than that of the material M1. As but one example, the material M2 can have a durometer in the range of 70 to 75 Asker C, inclusive, while the material M1 can have a durometer in the range of 55 to 60 Asker C, inclusive.

The forefoot pod 41 disposed in the second void 31F can rest on a bottom wall 31FB of the midsole 30. The forefoot pod can be wide enough to extend across the width of the forefoot. This width can provide a more stable base upon which the metatarsal heads M1-M5 are pushed downward against during part of the gait cycle, and in particular as the foot rolls to toe off. As a result, the user's foot, and more particularly, the ball of the foot experiences a more stable platform in that area. The pad 41 also can compress slightly into the material M1 of the midsole in the void 31F surrounding the forefoot pod 42. This can further dissipate and absorb the forces. The comfort pod also can provide good energy return to the foot right under the metatarsal heads M1-M5.

Optionally, the forefoot pod 41 can include an exterior surface 41S, which can correspond to the lateral surface as shown and/or a medial surface on the opposite side of the footwear. This exterior surface 41S of the forefoot pod on the lateral side L can be disposed a distance forward of the outer lateral shank wall 72W and the wall 30AL. Likewise, where the exterior surface 41S of the forefoot pod is on the medial side M of the footwear, it can be disposed a distance forward of the outer medial shank wall 30AM.

With reference to FIGS. 2, 4 and 5, the midsole 30 can include a downwardly opening recess 30R defined by the lower surface 32 of the midsole 30. This recess 30R can extend laterally, across the entire width WH of the sole in the heel region 16. The downwardly opening heel recess 30R can extend all the way to the surfaces or walls 30L1 and 30M1 on opposite sides of the footwear. This recess, however, does not extend to the midsole upper surface, nor is contiguous with the midsole upper surface 31. This heel recess 30R can be configured to be disposed under the heel of the foot of a wearer.

The downwardly opening recess 30R, sometimes referred to as a first void, can be defined in the midsole heel portion 30H. A heel pod 42 can be disposed in this downwardly opening recess 30R. This heel pod 42 can be constructed from the second material M2 as described in connection with the forefoot pod 41 above. Of course, it can be constructed from other materials as well. Generally, this heel pod 42 can be disposed in the first void 30R in the heel region of the footwear between the midsole 30 and an outsole upper surface 50U of the outsole 50. The heel pod 42 can be glued, cemented, fastened or otherwise secured to the upper surface 50U of the outsole 50 and the surfaces of the first void 30R. Optionally, in some embodiments, the first and second voids and associated heel and forefoot pods can be eliminated, with the midsole forming a solid one piece unit in the locations of these components.

With reference to FIG. 1, the heel pod 42 can include an exterior surface 42S, which can correspond to the lateral surface as shown and/or a medial surface on the opposite side of the footwear. This exterior surface 42S of the heel pod on the lateral side L can be disposed a distance rearward of the outer lateral shank wall 72W and the wall 30AL. Likewise, where the exterior surfaces 41S of the heel pod is on the medial side of the footwear, it can be disposed a distance rearward of the outer medial shank wall 71W and the wall 30AM.

As shown in FIG. 5, the outsole 50 disposed under the heel pod 42 can include an upwardly curved impact tread 50IT, also sometimes referred to as an upwardly curved rearmost heel strike tread portion. This impact tread 50IT can be curved and/or angled upward at an angle A2 relative to a lowermost plane LP through which most of the lowermost ground contact surface LGC and remainder of the outsole 50RLG extends. This angle A2 can be optionally at least 5°, at least 10°, at least 20°, at least 25° or at least 30°, depending on the application. Generally the impact tread 50IT curves upwardly, more toward the midsole, as the impact tread extends away and rearward in the heel region 16 of the footwear 10.

As mentioned above, the outsole 50 can include multiple lugs and/or treads that extend downward, or optionally can be relatively featureless, forming a smooth surface. Where present, the lugs and treads can be arranged as desired, and not necessarily in a repeating pattern. The lugs and treads can include one or more geometric shapes. The outsole tread can be constructed from one or more materials, for example, natural and/or synthetic rubber, thermoplastic polyurethane elastomers (TPU), nylon, polymer blends, wear resistant polymers, elastomers and/or other materials. Other materials, such as fiber-reinforced polymers can be used, which can include epoxy, polyethylene or thermosetting plastic reinforced with carbon, glass and/or aramid fibers for enhanced protection. The outsole material can have a durometer, optionally about 40 Shore A to about 70 Shore A, further optionally about 68 Shore A to 72 Shore A.

With particular reference to FIGS. 1-4, the outsole 50 can be disposed between the midsole and the bifurcated central shanks 70 as described below. As shown, the outsole 50 can include multiple forefoot tread sections, for example 51, 52, 53 and 54 that are joined with a longitudinal base section 55. Optionally, these tread sections 51-54 can be constructed in a cantilevered manner, extending outward from the base section 55. The upper surfaces of the sections can be joined directly to and can directly engage the midsole lower surface 32 in the regions overlapping the tread sections. These surfaces can be joined via gluing, cementing, melting, welding fastening or other techniques. Of course, in some constructions, the tread sections can be joined together and contiguous, with no gaps therebetween. In such constructions, the tread sections might have deep flex grooves defined by the outsole between them.

Where the tread sections 51-54 are joined with the midsole lower surface 32, that midsole lower surface is obscured and concealed by the outsole tread sections. However, between each of the tread sections, the midsole lower surface 32 optionally can be exposed through the respective gaps, for example gap 50G1, 50G2 and 50G3 in the forefoot. Thus, the portion forefoot 30F of the midsole 30 can be exposed through those gaps, but concealed where the tread sections are located. The heel midsole portion 30H can include similar gaps between respective heel tread sections. Each of these tread gaps can provide the outsole with increased flexibility and reduced weight in the respective regions, for example, the forefoot region, and the heel region. These forefoot tread sections also can include the lowermost ground contacting surface LGC of the footwear, which optionally can be forward and rearward of the arch region 14 of the footwear, and in some cases can overlap with that arch region. Optionally, although not shown the tread sections can be connected over parts of the gaps via small strips of interconnecting outsole material (not shown).

As shown in FIG. 3, the longitudinal base section 55 can extend from the forefoot region to the heel region, along the entire length of the footwear, but can be optionally interrupted in the arch region 14 below the midsole arch portion 30A. The longitudinal base section 55 can define a pressure curve groove 55G, also referred to as an outsole base groove, that undulates between a medial side M and a lateral side L of the footwear, which lay on opposite sides of the longitudinal axis LA. This pressure curve 55G can assist the outsole and the footwear in general to move more naturally with the wearer's foot during a gait cycle. This outsole base curve or groove 55G can extend back and forth across the longitudinal axis, on the lateral and medial sides thereof. This groove 55G can be interrupted in the arch region 14, generally under an arch midsole portion 30A as described below.

Where the midsole lower surface 32 is exposed in between gaps, for example the forefoot tread gaps, that midsole itself can define respective midsole lower surface grooves 32G. These grooves 32G can be transverse to the longitudinal axis LA of the footwear, and where included, transverse to the base section pressure curve groove 55G. These grooves 32G can further enhance the lateral side to side flexibility of the sole assembly 20, yet the tread sections below still provide adequate protection and rigidity to the sole assembly. Where the midsole lower surface 32 is exposed through the respective forefoot tread gaps, and defines such grooves 32G, these grooves can be referred to as forefoot flex grooves and they can further enhance the flexibility of the midsole in this region. Again, these forefoot flex grooves can be transverse to the outsole base groove 55G and the base section 55 as described above.

With reference to FIGS. 1 and 5, the outsole 50 can include a ladder tread section 56 that is disposed below the arch midsole portion 30A of the midsole 30. This ladder tread section 56 can be joined with the bifurcated central shanks as described below. The ladder tread section 56 can include a lowermost ladder tread ground contacting surface 56GC. This lowermost ladder tread ground contacting surface 56GC can be less than a distance D3 above a lowermost surface 50RLG of the forefoot tread sections and/or the heel tread sections, or generally above the lowermost ground contacting surface LGC of the outside adjacent the arch region. This distance D3 optionally can be less than 0.1 mm, less than 1 mm, less than 2 mm, less than 3 mm, less than 4 mm, less than 5 mm, less than 6 mm, less than 7 mm, less than 8 mm, less than 9 mm or less than 10 mm. Optionally, this distance D3 can be small enough such that, to the wearer, the outsole feels like it has a substantially flat ground contacting surface extending from the heel region to the forefoot region of the footwear, generally from under the heel of a wearer to the ball of a foot of the wearer. The lowered ladder tread section, with its lowermost surface 56GC that is disposed only a minute distance D3 above the lowermost ground contacting surface LGC of the remainder of the outsole treads, assists in providing the footwear with a substantially flat ground contacting surface under substantially all of the outsole and foot of the wearer.

The ladder tread section 56 can include one or more medial lugs or treads 56M and one or more lateral lugs or treads 56L. The medial lugs 56M can extend downward, away from the medial shank 71, and the lateral lugs 56L can extend downward, away from the lateral shank 72. The ground contacting surface 56GC and the ladder tread section 56 optionally can be interrupted for a distance D4 across the width of the footwear in the arch region between the lateral and medial treads or lugs. Within this distance D4, the outsole base section 55 can be relatively flat and tread less. As shown, this section can be void of any lugs extending directly downward from the outsole, under the shank connector 74 as described below.

The sole assembly 20 can include a bifurcated central shank 70, which optionally can include two or more central shanks 71 and 72 disposed on opposite sides of the longitudinal axis LA of the footwear. The shanks can be constructed from a rigid material, such as a polymer, a metal and/or a composite. The central shanks can include a lateral shank 72 and a medial shank 71. The lateral shank 72 can include a lateral shank base 72B and an outer lateral shank wall 72W that extends upward from the lateral shank base. The lateral shank 72 can include an interior lateral shank edge 72E disposed adjacent a longitudinal axis LA, distal from the wall 72W. The lateral shank 72 can include a forward edge 72F and a rearward edge 72R. The rearward edge 72R can extend under the heel midsole portion 30H, while the forward edge 72F can extend into and under the forefoot midsole portion 30F. Optionally, the forward edge 72F of the lateral shank 72 can terminate adjacent, slightly rearward or and/or under the fourth and fifth metatarsal heads M4 and M5 of a user's foot when the footwear 10 is worn.

The outer shank wall 72W can extend upward along an outer surface of the midsole. In some cases, the midsole can define a midsole arch lateral void 72V shown for example in FIGS. 2 and 7. The outer lateral shank wall 72W can extend upward in this void. That outer lateral shank wall 72W also can be visible by a viewer of a lateral side L of the footwear so that the viewer can confirm the central shank 70 is present. In some cases, the central shank 70 can be a different color from the remainder of the exterior of the midsole, such as a contrasting color, so the viewer can further confirm the shank is present.

The medial shank 71 can include a medial shank base 71B and an outer medial shank wall 71W that extends upward from the medial shank base 71B. The medial shank 71 can include an interior medial shank edge 71E disposed adjacent a longitudinal axis LA and inwardly distal from the wall 71W. The medial shank can include a forward edge 71F and a rearward edge 71R. The rearward edge 71R can extend under the heel midsole portion 30H, while the forward edge 71F can extend into the forefoot midsole portion 30F. Optionally, the forward edge 71F of the medial shank can terminate adjacent, slightly behind and/or under the first and second metatarsal heads M1 and M2 of a user's foot when the footwear 10 is worn.

The outer shank wall 71W can extend upward along an outer surface of the midsole. In some cases, the midsole can define a midsole arch medial void 71V, shown for example, in FIG. 7. The outer medial shank wall 71W can extend upward in this void. That outer medial shank wall also can be visible to a viewer of a medial side of the footwear so that the viewer can confirm the central shank is present.

Optionally, the medial shank 71 and the lateral shank 72 can be joined or connected to one another via a shank connector 74 that extends from the lateral shank to the medial shank. Of course, in other applications, the shanks can remain separate and individual parts. In general, the interior lateral shank edge 72E can face generally toward the interior medial shank edge 71E. These edges can be separated by a distance D4 that is optionally less than 40 mm, less than 30 mm, less than 20 mm, less than 10 mm, less than 5 mm, between 5 mm and 40 mm, inclusive, between 10 mm and 30 mm, inclusive, or between 5 mm and 20 mm inclusive. Where included, the connector shank 74 can be integrally formed with the two opposing edges and thereby can connect those two edges. The connector shank can be less than 10% or less than 25% the length of the medial shank and/or the lateral shank, depending on the application. In some cases, the connector shank and be absent from the central shank 70.

The various components and features of the embodiments herein, for example, the upper, sole or other footwear portions, can take on a variety of aesthetic forms, shapes and sizes. Although a particular component or feature can have a function, that feature can be expressed in different aesthetic manners to form an artistic design and/or purely ornamental design.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An article of footwear comprising:

an upper configured to receive a wearers foot, the upper extending longitudinally from a forefoot region toward a heel region, a midsole including a forefoot midsole portion disposed in the forefoot region of the footwear and a heel midsole portion disposed in the heel region of the footwear, with an arch midsole portion joining the forefoot midsole portion with the heel midsole portion, the arch midsole portion including a stability bridge comprising a first density, the heel midsole portion and the forefoot midsole portion comprising a second density less than the first density such that the arch midsole portion exhibits greater torsional stiffness than the forefoot midsole portion, the midsole including a midsole lower surface;

a bifurcated central shank disposed under the arch midsole portion and including a lateral shank and a medial shank, the lateral shank including a lateral shank base and an outer lateral shank wall that extends upward from the lateral shank base, the lateral shank including an interior lateral shank edge disposed adjacent the longitudinal axis of the sole assembly, the outer lateral shank wall being disposed in a midsole arch lateral void such that the outer lateral shank wall is visible by a viewer of a lateral side view of the footwear, the medial shank including a lateral shank base and an outer medial shank wall that extends upward from the medial shank base, the lateral shank including an interior lateral shank edge disposed adjacent the longitudinal axis of the sole assembly and facing generally toward but spaced a distance from the interior medial shank edge; and an outsole disposed below the midsole and the pair of rigid central shanks, the outsole including a plurality of forefoot tread sections in the forefoot that are separated from one another by respective forefoot tread gaps, such that the plurality of forefoot tread sections extend outward from a longitudinal base section in a cantilevered manner, the outsole joined with the lower surface of the midsole such that the midsole lower surface of the midsole is exposed through the respective forefoot tread gaps, between respective ones of the plurality of forefoot tread sections, the forefoot tread gaps configured to provide the outsole with increased flexibility and reduced weight in the forefoot region, the plurality of forefoot tread sections including a lowermost ground contacting surface, wherein the outsole includes a ladder tread section disposed in the arch region of the footwear, the ladder tread section joined with a lower surface of the respective pair of central shanks, the ladder tread section including a lowermost ground contacting surface that is less than 4 mm above a lowermost surface of the plurality of forefoot tread sections, whereby the outsole includes a substantially flat ground contacting surface extending from the heel region to the forefoot region of the footwear.

2. The article of footwear claim 1, wherein the midsole lower surface defines a downward opening first void in the heel midsole portion, wherein the midsole is constructed from a first material having the first density and the second density, wherein a heel pod is constructed from a second material, different from the first material, that is disposed in the first void in the heel region between the midsole and an outsole upper surface of the outsole.

3. The article of footwear of claim 2, wherein the midsole defines an upward opening second void in the forefoot midsole portion, wherein a forefoot pod is disposed in the second void in the forefoot region between the midsole and a Strobel board joined with the upper.

4. The article of footwear of claim 1, wherein the outsole includes a heel outsole portion disposed under the midsole heel portion, wherein the heel outsole portion includes an upwardly curved impact tread that curves upwardly, toward the midsole as the impact tread extends rearwardly in the heel region of the footwear.

5. The article of footwear of claim 1, wherein the lateral shank base extends under the midsole forefoot portion and terminates at a forward edge that is configured to be disposed behind a first metatarsal head of a wearer's foot when the wearer's foot is disposed in the footwear.

6. The article of footwear of claim 5, wherein the longitudinal base section extends from the forefoot region to the heel region of the footwear, wherein the longitudinal base section defines a pressure curve groove that undulates between a medial side of the footwear and a lateral side of the footwear disposed opposite one another across a longitudinal axis of the footwear.

7. The article of footwear of claim 1, wherein the lateral shank interior edge is separated from the medial shank interior edge adjacent the shank connector by the distance that is less than 20 mm.

8. The article of footwear of claim 1, wherein the arch midsole portion includes a medial bridge wall that extends upwardly from an upper surface of the midsole and a lateral bridge wall that extends upwardly from the upper surface of the midsole, wherein the medial bridge wall and lateral bridge wall extend upwardly adjacent respective panels of the upper on lateral and medial sides of the longitudinal axis of the footwear.

9. The article of footwear of claim 1, wherein the outer medial shank wall is disposed in a midsole arch medial void such that the outer medial shank wall is visible to a viewer of a medial side view of the footwear.

10. The article of footwear of claim 9, wherein the medial shank base includes a medial shank lower surface, wherein the ladder tread section includes a medial lug extending downward away from the medial shank lower surface, wherein the lateral shank base includes a lateral shank lower surface, wherein the ladder tread section includes a medial lug extending downward from the lateral shank lower surface, wherein the ladder tread section is void of lugs extending directly downward between the lateral shank lower surface and the medial shank lower surface.

11. The article of footwear of claim 1, wherein the stability bridge of the midsole is disposed between the outer lateral shank wall and the outer medial shank wall, wherein the stability bridge of the midsole is disposed above the lateral shank base and the medial shank base.

12. The article of footwear of claim 11, wherein the arch midsole portion includes a medial bridge wall that extends upwardly from an upper surface of the midsole, above the stability bridge, and a lateral bridge wall that extends upwardly from the upper surface of the midsole, above the stability bridge, wherein the medial bridge wall and lateral bridge wall extend upwardly adjacent respective panels of the upper on medial and lateral sides of the longitudinal axis of the footwear.

13. The article of footwear of claim 1, wherein the longitudinal base section defines an outsole base groove that undulates between a lateral side and a medial side of the sole assembly in the forefoot region, wherein the midsole lower surface of the midsole that is exposed through the respective forefoot tread gaps defines at least one forefoot flex groove that is transverse to the outsole base groove.

14. The article of footwear of claim 1 comprising:

a forefoot pod that is constructed from a second material different from a first material from which the midsole is constructed, the forefoot pod being disposed in an upwardly opening void that is defined in the forefoot midsole portion, the upwardly opening void being above, and non-coextensive with, the lower surface of the midsole, wherein the forefoot pod extends laterally across the entire width of the forefoot outsole portion such that a lateral surface of the forefoot pod is visible to a viewer viewing a lateral side of the sole assembly, and such that a medial surface of the forefoot pod is visible to a viewer viewing a medial side of the sole assembly, the lateral surface of the forefoot pod being separated a first distance from the outer lateral shank wall, the medial surface of the forefoot pod being separated a second distance from the outer medial shank wall.

15. The article of footwear of claim 14 comprising:

a heel pod that is constructed from the second material, the forefoot pod being disposed in a downwardly opening void that is defined in the heel midsole portion, wherein the heel pod extends laterally across the entire width of the heel outsole portion such that a lateral surface of the heel pod is visible to a viewer viewing a lateral side of the sole assembly and such that a medial surface of the heel pod is visible to a viewer viewing a medial side of the sole assembly, the lateral surface of the heel pod being disposed rearward of the outer lateral shank wall, the medial surface of the heel pod being disposed rearward of the outer medial shank wall.

16. An article of footwear comprising:

an upper configured to receive a wearer's foot, the upper extending longitudinally from a forefoot region toward a heel region, a midsole including a forefoot midsole portion disposed in the forefoot region of the footwear and a heel midsole portion disposed in the heel region of the footwear, with an arch midsole portion joining the forefoot midsole portion with the heel midsole portion, a bifurcated rigid central shank disposed under the arch midsole portion including a lateral shank and a medial shank, the lateral shank being visible to a viewer of a lateral side view of the footwear, the medial shank being visible to a viewer of a medial side view of the footwear, the lateral shank including an interior lateral shank edge facing generally toward but spaced a distance from an interior medial shank edge of the medial shank, the medial shank extending farther forward into the forefoot region of the footwear than the lateral shank; and an outsole disposed below the midsole and the bifurcated central shank, the outsole joined with a lower surface of the midsole, wherein the arch midsole portion includes a stability bridge comprising a first density, the heel midsole portion and the forefoot midsole portion comprising a second density less than the first density such that the arch midsole portion exhibits greater torsional stiffness than the forefoot midsole portion and the heel midsole portion, wherein the stability bridge, heel midsole portion and forefoot midsole portion are constructed from a foam material.

17. The article of footwear of claim 16, wherein the midsole lower surface of the midsole is exposed through respective forefoot tread gaps defined by the outsole, the forefoot tread gaps configured to provide the outsole with increased flexibility and reduced weight in the forefoot region, the plurality of forefoot tread sections including a lowermost ground contacting surface.

18. The article of footwear of claim 16, wherein the outsole includes a ladder tread section disposed in the arch region of the footwear, the ladder tread section disposed immediately below the bifurcated central shank, the ladder tread section including a lowermost ground contacting surface that is less than 4 mm above a lowermost surface of the remainder of the outsole so that the outsole includes a substantially flat ground contacting surface extending between the forefoot region and the heel region of the footwear.

19. The article of footwear of claim 16, comprising:

a forefoot pod that is constructed from a second material different from a first material from which the midsole is constructed, the forefoot pod being disposed in and upwardly opening void that is defined in the forefoot midsole portion, distal from a midsole lower surface, wherein the forefoot pod extends laterally across the entire width of the forefoot outsole portion such that a lateral surface of the forefoot pod is visible to a viewer viewing a lateral side of the sole assembly and such that a medial surface of the forefoot pod is visible to a viewer viewing a medial side of the sole assembly, the lateral surface of the forefoot pod being separated a first distance from the visible lateral shank, the medial surface of the forefoot pod being separated a second distance from the visible medial shank; and a heel pod disposed in a downwardly opening void that is defined in the heel midsole portion and adjacent the midsole lower surface, such that a heel pod lower surface is flush with the midsole lower surface, wherein the heel pod extends laterally across the entire width of the heel outsole portion such that a lateral surface of the heel pod is visible to a viewer viewing a lateral side of the sole assembly and such that a medial surface of the heel pod is visible to a viewer viewing a medial side of the sole assembly, the lateral surface of the heel pod being disposed rearward of the visible lateral shank, the medial surface of the heel pod being disposed rearward of the visible medial shank.

20. An article of footwear comprising:

an upper configured to receive a wearer's foot;

a midsole including a forefoot midsole portion and a heel midsole portion, with an arch midsole portion joining the forefoot midsole portion with the heel midsole portion, the arch midsole portion including a stability bridge to enhance torsional rigidity in an arch region of the footwear;

a bifurcated rigid central shank disposed under the arch midsole portion including a lateral shank and a medial shank, the lateral shank being visible to a viewer of a lateral side view of the footwear, the medial shank being visible to a viewer of a medial side view of the footwear; and an outsole disposed below the midsole and the bifurcated central shank, the outsole including a ladder tread section disposed in the arch region of the footwear, the ladder tread section disposed immediately below the bifurcated central shank, the latter tread section including a lowermost ground contacting surface that is less than 3 mm above a lowermost surface of the remainder of the outsole so that the outsole includes a substantially flat ground contacting surface extending between the forefoot region and the heel region of the footwear, the outsole including an upwardly curved rearmost heel strike tread portion.

* * * * *